US008702029B1

(12) United States Patent
Thompson

(10) Patent No.: US 8,702,029 B1
(45) Date of Patent: Apr. 22, 2014

(54) WIRE REEL HOLDER AND DISPENSING ASSEMBLY

(76) Inventor: David D. Thompson, Lancaster, TX (US)

( * ) Notice: Subject to any disclaimer, the term of this patent is extended or adjusted under 35 U.S.C. 154(b) by 261 days.

(21) Appl. No.: 13/180,885

(22) Filed: Jul. 12, 2011

(51) Int. Cl.
*B65H 16/02* (2006.01)

(52) U.S. Cl.
USPC ..... 242/557; 242/403; 242/533.8

(58) Field of Classification Search
USPC ..... 242/403, 533.8, 557
See application file for complete search history.

(56) References Cited

U.S. PATENT DOCUMENTS

| | | | | |
|---|---|---|---|---|
| 2,521,321 | A | 9/1950 | Ax et al. | |
| 3,820,733 | A | 6/1974 | Roederer | |
| 3,967,793 | A | 7/1976 | Walker | |
| 4,473,196 | A | 9/1984 | Sammann et al. | |
| 4,946,113 | A | 8/1990 | Riffle et al. | |
| 5,246,182 | A | 9/1993 | Lester | |
| 5,476,234 | A * | 12/1995 | St. Pierre | 242/557 |
| 5,568,900 | A * | 10/1996 | Conroy | 242/557 |
| 6,637,688 | B1 | 10/2003 | Nelson | |
| 6,951,316 | B1 * | 10/2005 | Heidelberger | 242/557 |
| 7,264,195 | B2 | 9/2007 | Fletcher et al. | |
| 7,530,523 | B1 * | 5/2009 | Murray | 242/557 |
| 2002/0148919 | A1 | 10/2002 | Potts | |
| 2006/0266877 | A1 | 11/2006 | Feather | |
| 2006/0289693 | A1 | 12/2006 | Saavedra et al. | |
| 2010/0090053 | A1 | 4/2010 | Stiltner | |

* cited by examiner

*Primary Examiner* — Sang Kim

(57) ABSTRACT

A wire reel holder and dispensing assembly is provided for transporting, holding, and dispensing wire from a wire reel. The holder and assembly includes an elongated shaft configured for insertion through a wire reel. Each of a pair of end members has a polygonal outer perimeter edge and a central opening. The shaft is slidably insertable through the central opening of each end member positioning the end members at each end of the wire reel. Each end member is securable to the shaft to hold the wire reel in a static position along a length of the shaft and prevent rolling of the wire reel on the shaft. A holding assembly is provided for connecting the shaft, end members and wire reel to a vehicle.

10 Claims, 6 Drawing Sheets

WIRE REEL HOLDER AND DISPENSING ASSEMBLY

BACKGROUND OF THE DISCLOSURE

Field of the Disclosure

The disclosure relates to wire dispensing devices and more particularly pertains to a new wire dispensing device for transporting, holding, and dispensing wire from a wire reel.

SUMMARY OF THE DISCLOSURE

An embodiment of the disclosure meets the needs presented above by generally comprising an elongated shaft configured for insertion through a wire reel. Each of a pair of end members has a polygonal outer perimeter edge and a central opening. The shaft is slidably insertable through the central opening of each end member positioning the end members at each end of the wire reel. Each end member is securable to the shaft to hold the wire reel in a static position along a length of the shaft and prevent rolling of the wire reel on the shaft.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
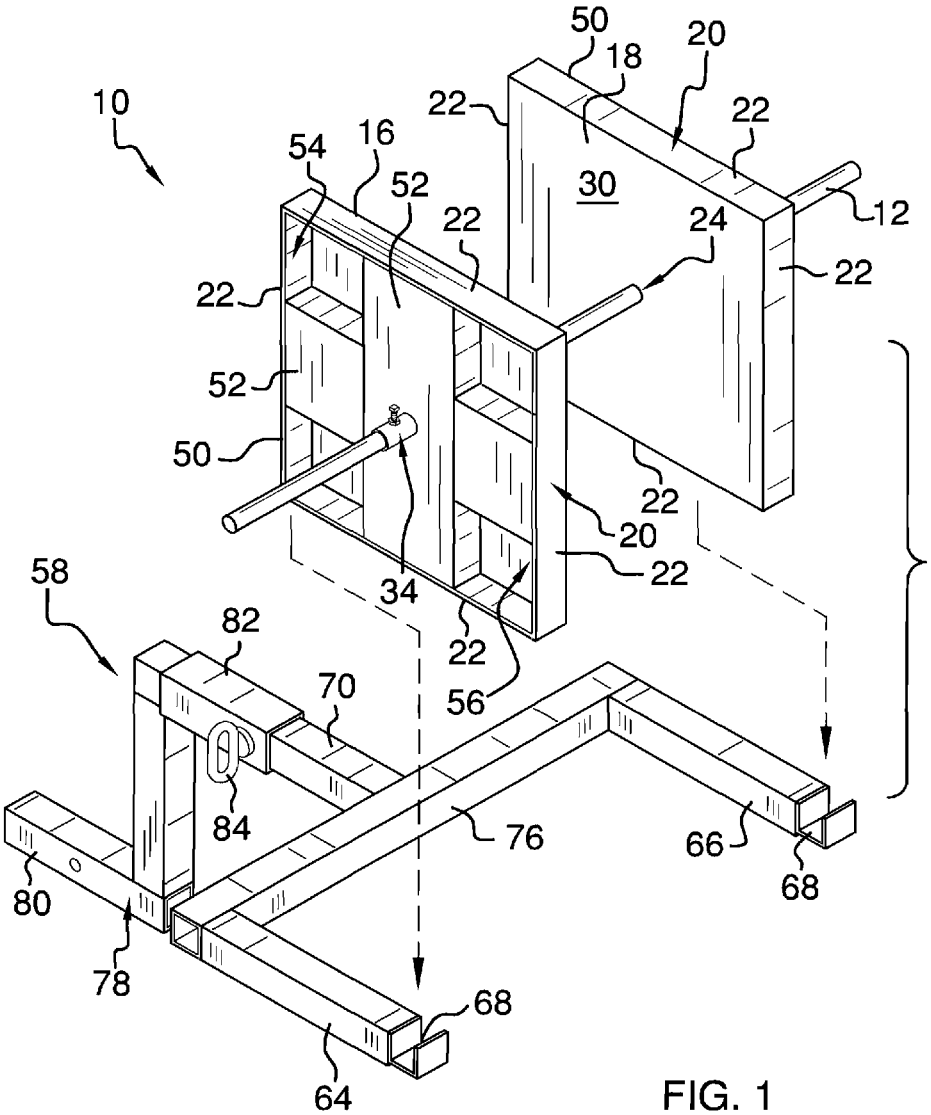
FIG. 1 is a partially exploded top front side perspective view of a wire reel holder and dispensing assembly according to an embodiment of the disclosure.
Figure 2:
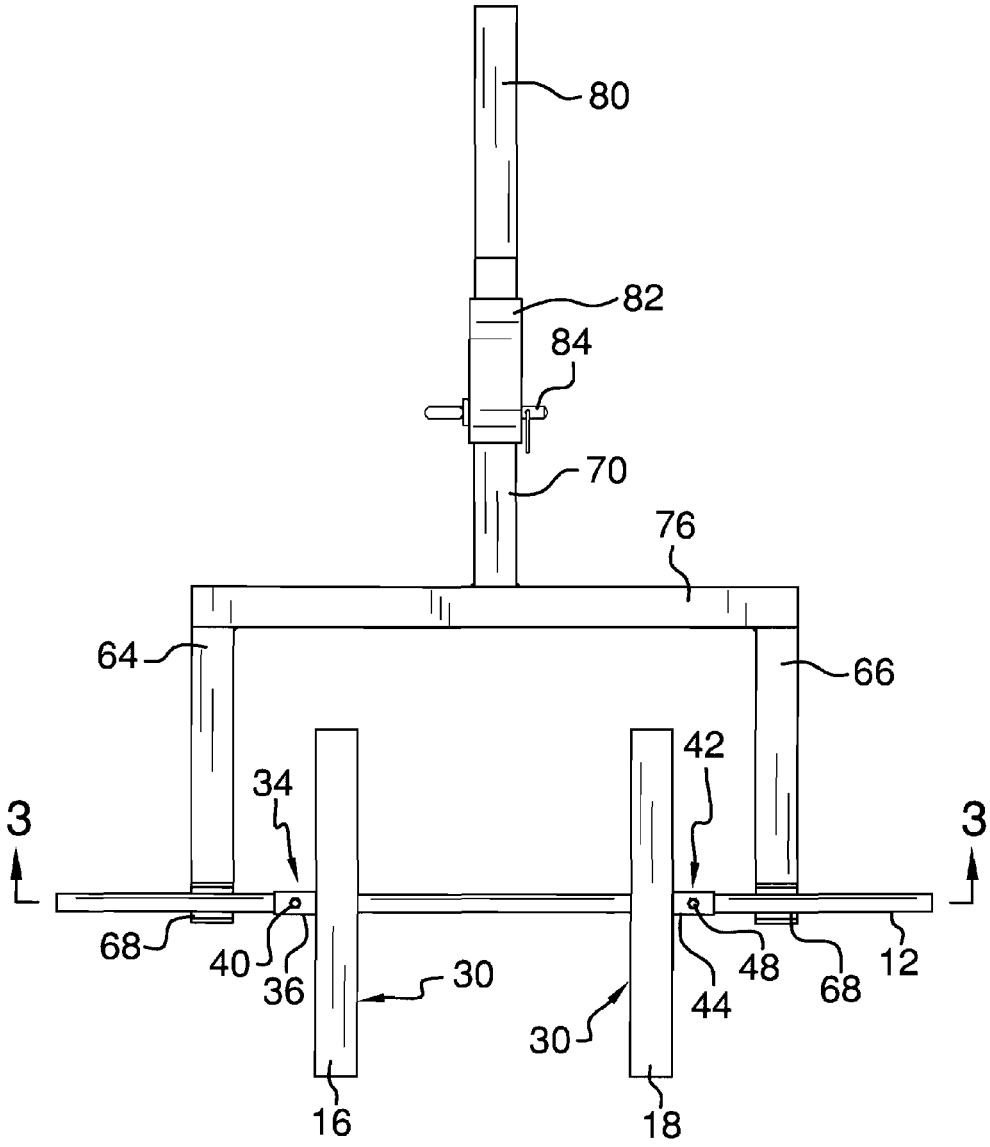
FIG. 2 is a top view of an embodiment of the disclosure.
Figure 3:
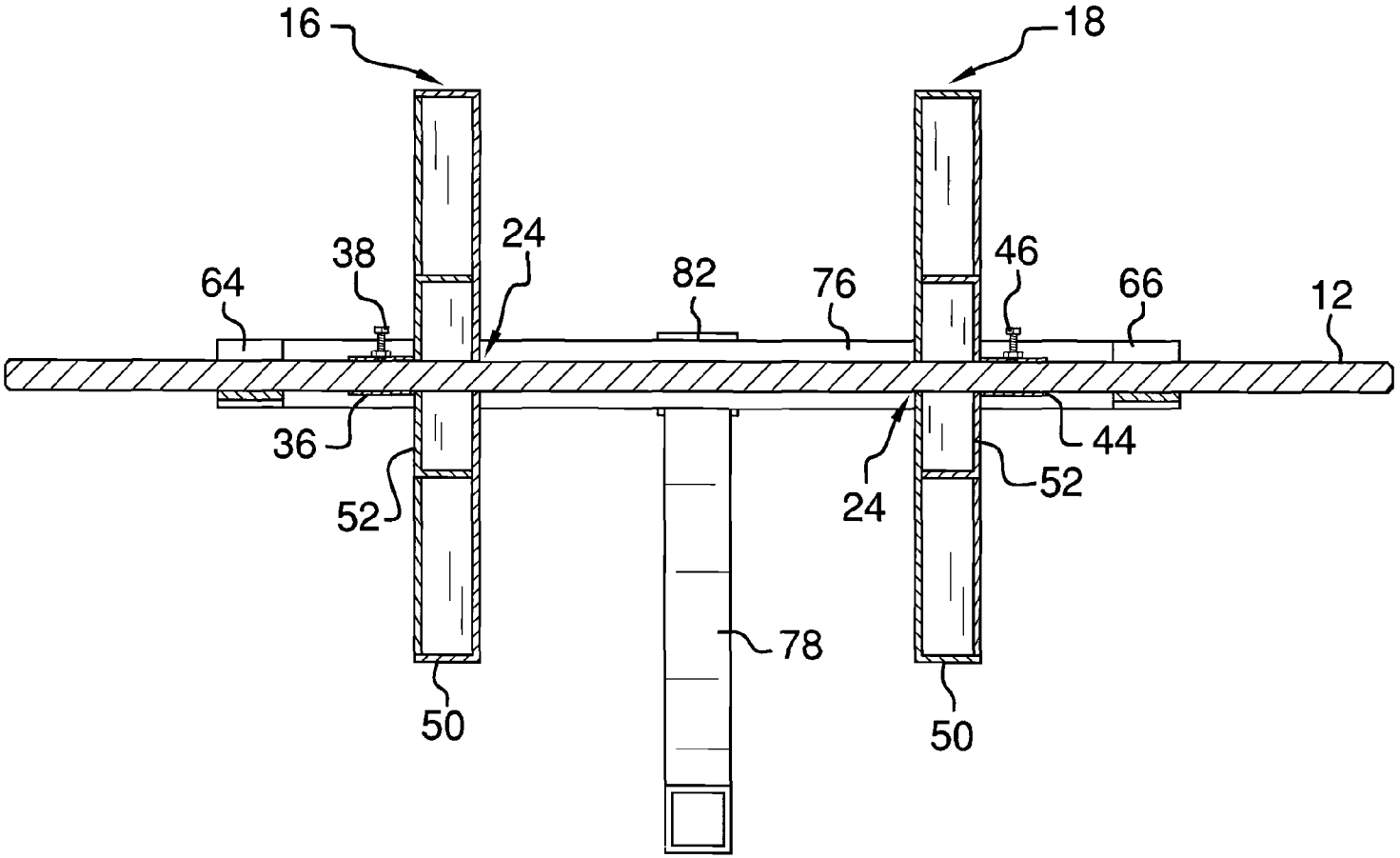
FIG. 3 is a cross-sectional view of an embodiment of the disclosure taken along line 3-3 of FIG. 2.
Figure 4:
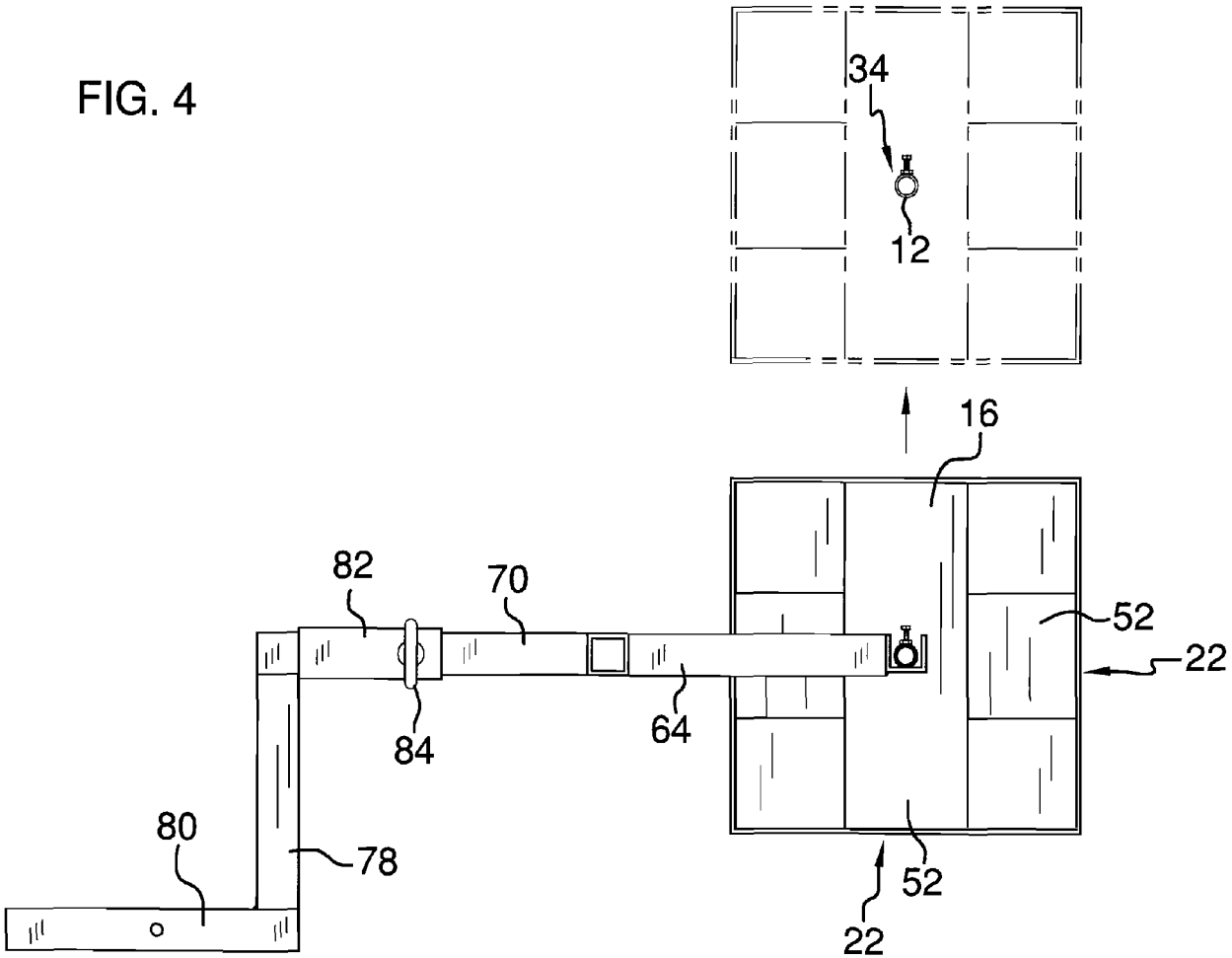
FIG. 4 is a side view of an embodiment of the disclosure.
Figure 5:
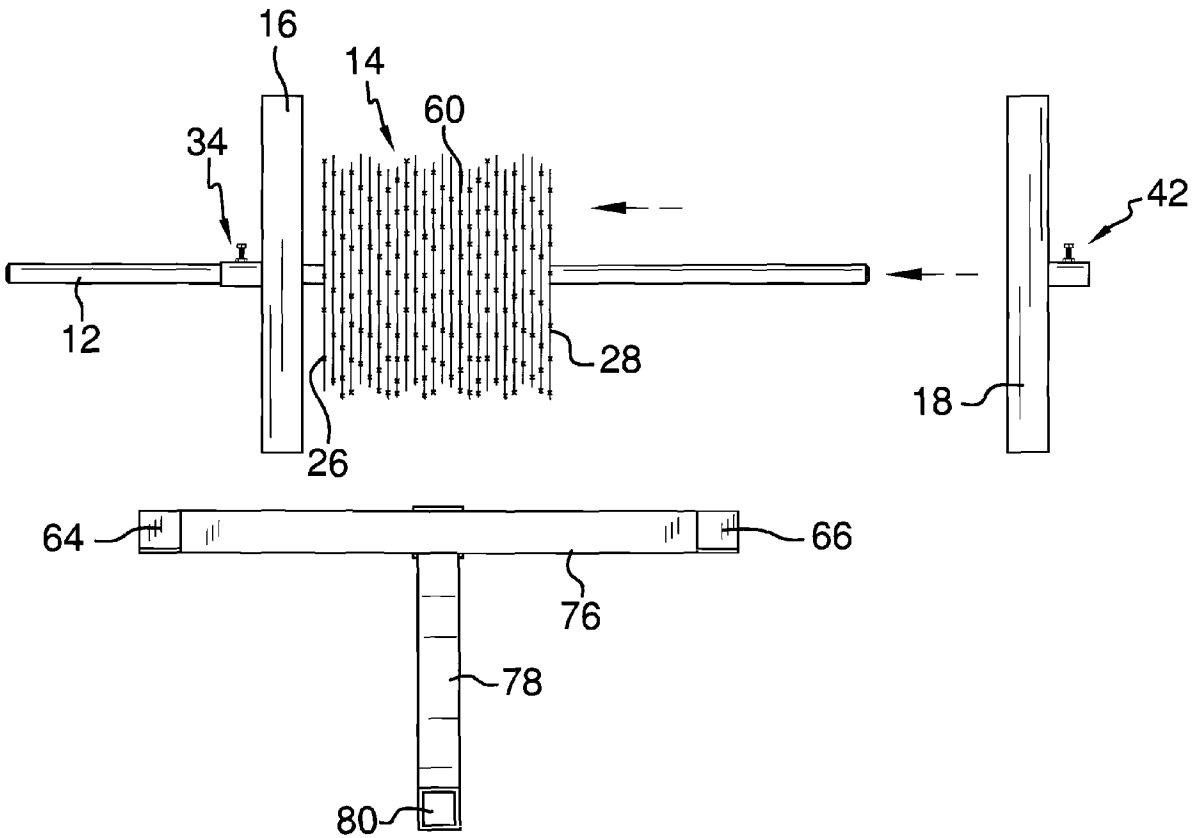
FIG. 5 is a partially exploded front view of an embodiment of the disclosure.
Figure 6:
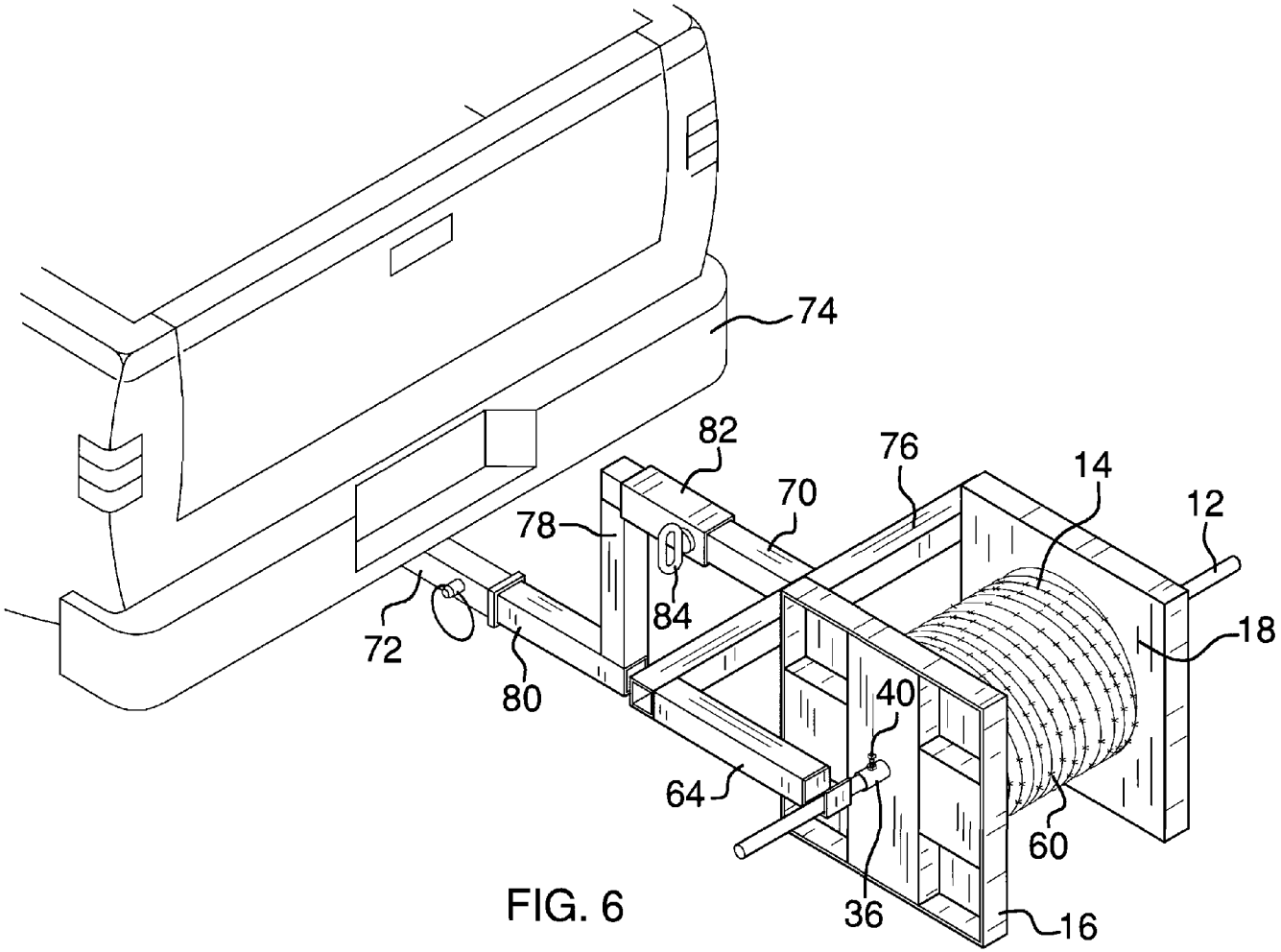
FIG. 6 is a top front side perspective view of an embodiment of the disclosure in use.

With reference now to the drawings, and in particular to FIGS. 1 through 6 thereof, a new wire dispensing device embodying the principles and concepts of an embodiment of the disclosure and generally designated by the reference numeral 10 will be described.

As best illustrated in FIGS. 1 through 6, the wire reel holder and dispensing assembly 10 generally comprises an elongated shaft 12 configured for insertion through a wire reel 14. A pair of end members 16,18 each have a polygonal outer perimeter edge 20. During use the end members 16,18 mirror each other providing flat surfaces 22 to prevent unintended rolling of the end members 16,18. Each end member 16,18 further has a central opening 24. The shaft 12 is slidably insertable through the central opening 24 of each end member 16,18. Thus, the end members 16,18 are configured for positioning at each end 26,28 of the wire reel 14. Each end member 16,18 is securable to the shaft 12 in a manner that the end member 16,18 is held in a static position along a length of the shaft 12. The end members 16,18 are configured for compressing or abutting against the wire reel 14 to secure the wire reel 14 in a static position relative to the end members 16,18 and the shaft 12. The end members 16,18 each have a planar surface 30. The planar surfaces 30 of each end member 16,18 face each other when the end members 16,18 are coupled to the shaft 12 on opposite sides 26,28 of the wire reel 14.

A first locking assembly 34 is coupled to a first one of the end members 16. The first locking assembly 34 may include a collar 36 slidably receiving the shaft 12 and a locking screw 38 coupled to the collar 36 of the first locking assembly 34. The locking screw 38 of the first locking assembly 34 is transversely extendable through a threaded hole 40 in the collar 36 to contact the shaft 12. In this manner, the first end member 16 is held in a static position relative to the shaft 12 by frictional contact with the locking screw 38. Similarly, a second locking assembly 42 is coupled to the second one of the end members 18. The second locking assembly 42 also has a collar 44 slidably receiving the shaft 12 and a locking screw 46 coupled to the collar 44 of the second locking assembly 42. The locking screw 46 of the second locking assembly 42 is transversely extendable through a threaded hole 48 in the collar 44 to contact the shaft 12. The second end member 18 is therefore also held in a static position relative to the shaft 12 by frictional engagement when the locking screw 44 is tightened.

A perimeter wall 50 of each end member 16,18, extends from the planar surface 30 forming the outer perimeter edge 20 of the respective end member 16,18. A plurality of reinforcing members 52 is provided. Each reinforcing member 52 is coupled to and extends between opposed sides 54,56 of the perimeter wall 50 of an associated one of the end members 16,18.

A holding assembly 58 is provided to support the shaft 12 in a horizontal elevated position to permit rotation and distribution of wire 60 from the wire reel 14. The holding assembly 58 has a pair of spaced arms 64,66. The spaced arms 64,66 have aligned slots 68 receiving the shaft 12. The spaced arms 64,66 are configured for positioning the wire reel 14 and the end members 16,18 between the spaced arms 64,66 when the shaft 12 is received in the slots 68 in the spaced arms 64,66. The holding assembly 58 also has a hitch connector 70 coupled to and extending away from the spaced arms 64,66. A cross-member 76 of the holding assembly 58 extends between the spaced arms 64,66 and the hitch connector 70 extends transversely from the cross-member 76. The hitch connector 70 is configured for direct attachment to a vehicle hitch 72 whereby the wire reel 14 may be transported by a vehicle 74.

Alternatively, particularly for vehicles with low hitch connection points, an offset connector 78 may be coupled to and extend from the hitch connector 70. The offset connector 78 has a distal section 80 relative to the hitch connector 70. The distal section 80 is configured for coupling directly to the vehicle hitch 72. The distal section 80 is offset from the hitch connector 70 whereby the spaced arms 64,66 are positioned at an elevated height relative to the distal section 80. A locking sleeve 82 is coupled to the offset connector 78 and the hitch connector 52. The hitch connector 52 is slidably inserted into the locking sleeve 82. A pin 84 is insertable through the locking sleeve 82 and the hitch connector 52 whereby the hitch connector 52 is securely coupled to the offset connector 78.

The shaft 12 may have a diameter between 2 centimeters and 2.5 centimeters. The end members 16,18 may each be square shaped having sides between 42 and 44 centimeters in length. The hitch connector 70 may have a length between 24 and 26 centimeters long constructed out of square tubing having sides between 4 and 6 centimeters in length. The offset connector 78 may raise the hitch connector 70 between 34 and 37 centimeters.

In use, the shaft 12 is inserted through one end member 16, through the wire reel 14, and then through the second end member 18. The first and second locking assemblies 34 and 42 are manipulated to secure the end members 16, 18 to hold the wire reel 14 in place. The wire reel 14 may then be held easily by grasping the shaft 12. If needed the wire reel 14 may be placed on the ground and the flat surfaces 22 prevent the wire reel 14 from rolling. The flat surfaces 22 also prevent unintended rolling if the wire reel 14 is accidentally dropped. When desired, the shaft 12 may be placed into the slots 68 of the holding assembly 58. The holding assembly 58, with or without the offset connector 78, may be connected to a vehicle hitch 72.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A wire reel holder assembly comprising:

an elongated shaft configured for insertion through a wire reel;

a pair of end members, each end member having a polygonal outer perimeter edge, each end member having a central opening, said shaft being slidably insertable through said central opening of each end member whereby said end members are configured for positioning at each end of the wire reel, each end member being securable to said shaft whereby said end member is held in a static position along a length of said shaft and said end members are configured for compressing the wire reel into a static position relative to said end members;

a holding assembly, said holding assembly having a pair of spaced arms, said spaced arms having aligned slots receiving said shaft, said spaced arms being configured for positioning the wire reel between said spaced arms when said shaft is received in said slots in said spaced arms, said holding assembly having a hitch connector coupled to and extending from said spaced arms, said hitch connector being configured for attachment to a vehicle hitch whereby the wire reel is transportable by a vehicle;

a cross-member of said holding assembly extending between said spaced arms, said hitch connector extending from said cross-member;

an offset connector coupled to and extending from said hitch connector, said offset connector having a distal section relative to said hitch connector, said distal section being configured for coupling to the vehicle hitch, said distal section being offset from said hitch connector whereby said spaced arms are positionable at an elevated height relative to said distal section;

a locking sleeve coupled to said offset connector, said hitch connector being slidably inserted into said locking sleeve; and a pin insertable through said locking sleeve and said hitch connector whereby said hitch connector is securely coupled to said offset connector.

2. The assembly of claim 1, further including said end members each having a planar surface, said planar surfaces facing each other when said end members are coupled to said shaft.

3. The assembly of claim 2, further including each end member having a perimeter wall extending from said planar surface forming said outer perimeter edge.

4. The assembly of claim 3, further including reinforcing members coupled to and extending between opposed sides of said perimeter wall of each end member.

5. The assembly of claim 1, further including a first locking assembly coupled to a first one of said end members.

6. The assembly of claim 5, further including said first locking assembly having a collar slidably receiving said shaft and a locking screw coupled to said collar of said first locking assembly, said locking screw of said first locking assembly being transversely extendable through said collar of said first locking assembly to contact said shaft whereby said first end member is held in a static position relative to said shaft.

7. The assembly of claim 5, further including a second locking assembly coupled to a second one of said end members.

8. The assembly of claim 7, further including said second locking assembly having a collar slidably receiving said shaft and a locking screw coupled to said collar of said second locking assembly, said locking screw of said second locking assembly being transversely extendable through said collar of said second locking assembly to contact said shaft whereby said second end member is held in a static position relative to said shaft.

9. The assembly of claim 1, wherein said polygonal shape is a square.

10. A wire reel holder assembly comprising:

an elongated shaft configured for insertion through a wire reel;

a pair of end members, each end member having a polygonal outer perimeter edge, each end member having a central opening, said shaft being slidably insertable through said central opening of each end member whereby said end members are configured for positioning at each end of the wire reel, each end member being securable to said shaft whereby said end member is held in a static position along a length of said shaft and said end members are configured for compressing the wire reel into a static position relative to said end members, said end members each having a planar surface, said planar surfaces facing each other when said end members are coupled to said shaft;

a first locking assembly coupled to a first one of said end members, said first locking assembly having a collar slidably receiving said shaft and a locking screw coupled to said collar of said first locking assembly, said locking screw of said first locking assembly being transversely extendable through said collar of said first locking assembly to contact said shaft whereby said first end member is held in a static position relative to said shaft;

a second locking assembly coupled to a second one of said end members, said second locking assembly having a collar slidably receiving said shaft and a locking screw coupled to said collar of said second locking assembly, said locking screw of said second locking assembly being transversely extendable through said collar of said second locking assembly to contact said shaft whereby said second end member is held in a static position relative to said shaft;

a perimeter wall of each end member extending from said planar surface forming said outer perimeter edge of said end member;

a plurality of reinforcing members, each reinforcing member being coupled to and extending between opposed sides of said perimeter wall of an associated one of said end members;

a holding assembly, said holding assembly having a pair of spaced arms, said spaced arms having aligned slots receiving said shaft, said spaced arms being configured for positioning the wire reel between said spaced arms when said shaft is received in said slots in said spaced arms, said holding assembly having a hitch connector coupled to and extending from said spaced arms, said hitch connector being configured for attachment to a vehicle hitch whereby the wire reel is transportable by a vehicle;

a cross-member of said holding assembly extending between said spaced arms, said hitch connector extending from said cross-member;

an offset connector coupled to and extending from said hitch connector, said offset connector having a distal section relative to said hitch connector, said distal section being configured for coupling to the vehicle hitch, said distal section being offset from said hitch connector whereby said spaced arms are positionable at an elevated height relative to said distal section;

a locking sleeve coupled to said offset connector, said hitch connector being slidably inserted into said locking sleeve; and a pin insertable through said locking sleeve and said hitch connector whereby said hitch connector is securely coupled to said offset connector.

* * * * *